US006250310B1

(12) United States Patent
Spatafora

(10) Patent No.: US 6,250,310 B1
(45) Date of Patent: Jun. 26, 2001

(54) CIGARETTE MANUFACTURING MACHINE

(75) Inventor: Mario Spatafora, Bologna (IT)

(73) Assignee: G.D. Societa' per Azioni, Bologna (IT)

( * ) Notice: Subject to any disclaimer, the term of this patent is extended or adjusted under 35 U.S.C. 154(b) by 0 days.

(21) Appl. No.: 09/354,020

(22) Filed: Jul. 15, 1999

(30) Foreign Application Priority Data

Jul. 20, 1998 (IT) ..... BO98A0449

(51) Int. Cl.[7] ..... A24C 5/18; B26D 7/06

(52) U.S. Cl. ..... 131/84.4; 131/84.2; 131/84.1; 83/100; 83/122; 83/931

(58) Field of Search ..... 131/84.4, 84.2, 131/84.1, 108, 84.3; 83/100, 122, 931

(56) References Cited

U.S. PATENT DOCUMENTS 2,660,178 11/1953 Rault .
5,325,874 7/1994 Heitmann .

FOREIGN PATENT DOCUMENTS 38 37 201 5/1989 (DE) .
0 137 604 4/1985 (EP) .
0 354 874 1/1990 (EP) .
0 645 098 3/1995 (EP) .
2 172 187 9/1986 (GB) .

*Primary Examiner*—Stanley S. Silverman
*Assistant Examiner*—Dionne A. Walls
(74) *Attorney, Agent, or Firm*—Marshall, O'Toole, Gerstein, Murray & Borun

(57) ABSTRACT

A cigarette manufacturing machine having a shaving device for shaving at least one bead of tobacco, wherein two superimposed, mutually contacting disks with respective serrated outer edges are rotated about a common axis at different peripheral speeds to shave the bead of tobacco fed against the disks.

14 Claims, 6 Drawing Sheets

CIGARETTE MANUFACTURING MACHINE

The present invention relates to a cigarette manufacturing machine.

BACKGROUND OF THE INVENTION

On cigarette manufacturing machines, a continuous bead of tobacco is fed, normally by means of a suction conveyor belt, onto a forming beam, at the input of which, the tobacco bead is fed onto a continuous paper strip which is gradually folded transversely about the bead along the forming beam to form a continuous cigarette rod.

To maintain a constant amount of tobacco along the bead, the machine is equipped with a shaving device, which interferes with the bead as this is fed towards the forming beam, so as to obtain a substantially constant bead section.

U.S. Pat. No. 5,325,874 describes a shaving device comprising two parallel, counter-rotating disks with respective peripheral portions tangent to each other at a point along the path of the tobacco bead.

The counter-rotating disks have sharp edges for detaching the surplus tobacco from the bead, which surplus is then removed by a cutting device and fed to the input of a tobacco collecting device.

Though highly efficient, the above shaving device has a relatively bulky structure, both crosswise to the tobacco bead, on account of the two side by side counter-rotating disks, and parallel to the tobacco bead, on account of the cutter for removing the surplus tobacco detached by the two counter-rotating disks.

The above shaving device also has a fairly complex, and therefore high-cost, structure on account of the surplus tobacco cutter.

One solution to the above drawback is proposed in U.S. Pat. No. 2,660,178, which describes a shaving device having two superimposed blades oscillating with respect to each other in a direction crosswise to the traveling direction of the tobacco bead.

Each blade has a serrated edge contacting the tobacco bead, and which cooperates with the serrated edge of the other blade to cut the surplus tobacco.

Though relatively compact, the reciprocating movement of the above shaving device results in severe vibration—especially at the high operating speeds of modern manufacturing machines—which in turn reduces the working life of the device itself.

SUMMARY OF THE INVENTION

It is an object of the present invention to provide a cigarette manufacturing machine designed to eliminate the aforementioned drawbacks, and which at the same time is cheap and easy to produce.

According to the present invention, there is provided a cigarette manufacturing machine comprising supply means for feeding at least one bead of tobacco along a given path; and at least one shaving device located along said path to shave said bead, and which in turn comprises two shaving disks, each parallel to said path and mounted to rotate about a respective axis crosswise to said path; characterized in that said two shaving disks comprise respective serrated outer edges having a superimposed portion interfering with said bead along said path; said shaving device also comprising actuating means for imparting to said two shaving disks a relative speed with respect to each other.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
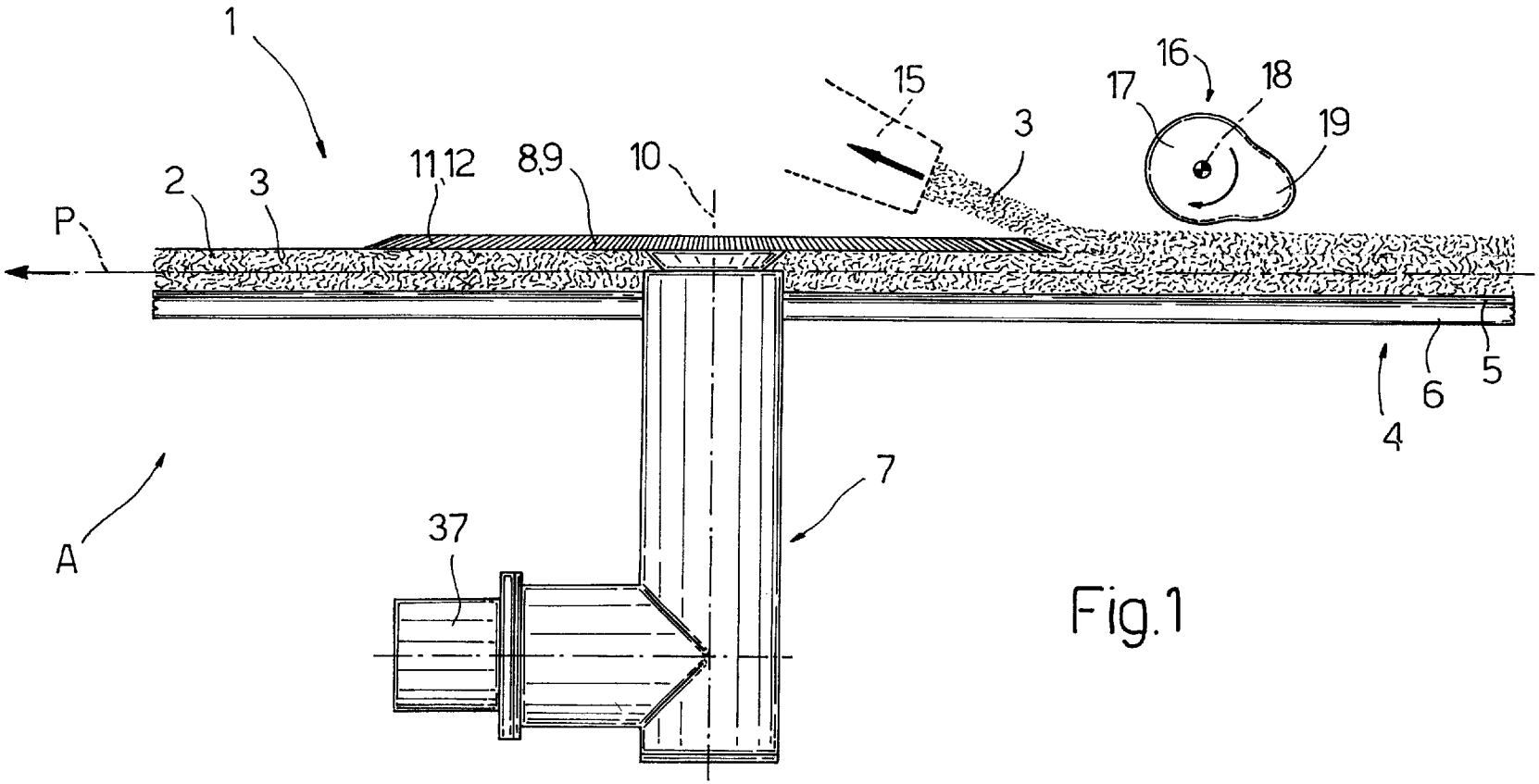
FIG. 1 shows a side view of a detail of the cigarette manufacturing machine according to the present invention.

Letter A in FIG. 1 indicates a cigarette manufacturing machine comprising a shaving device 1 for shaving a bead 2 of tobacco 3 fed along a path P by a supply device 4 comprising a suction conveyor belt 5 traveling along a supporting beam 6 extending along path P.

In the example embodiment shown, bead 2 is located, for the sake of simplicity, on top of belt 5, and supporting beam 6 is located beneath belt 5, whereas, in actual fact, bead 2 is located beneath belt 5, and beam 6 is a suction supporting beam located over belt 5.

Figure 2:
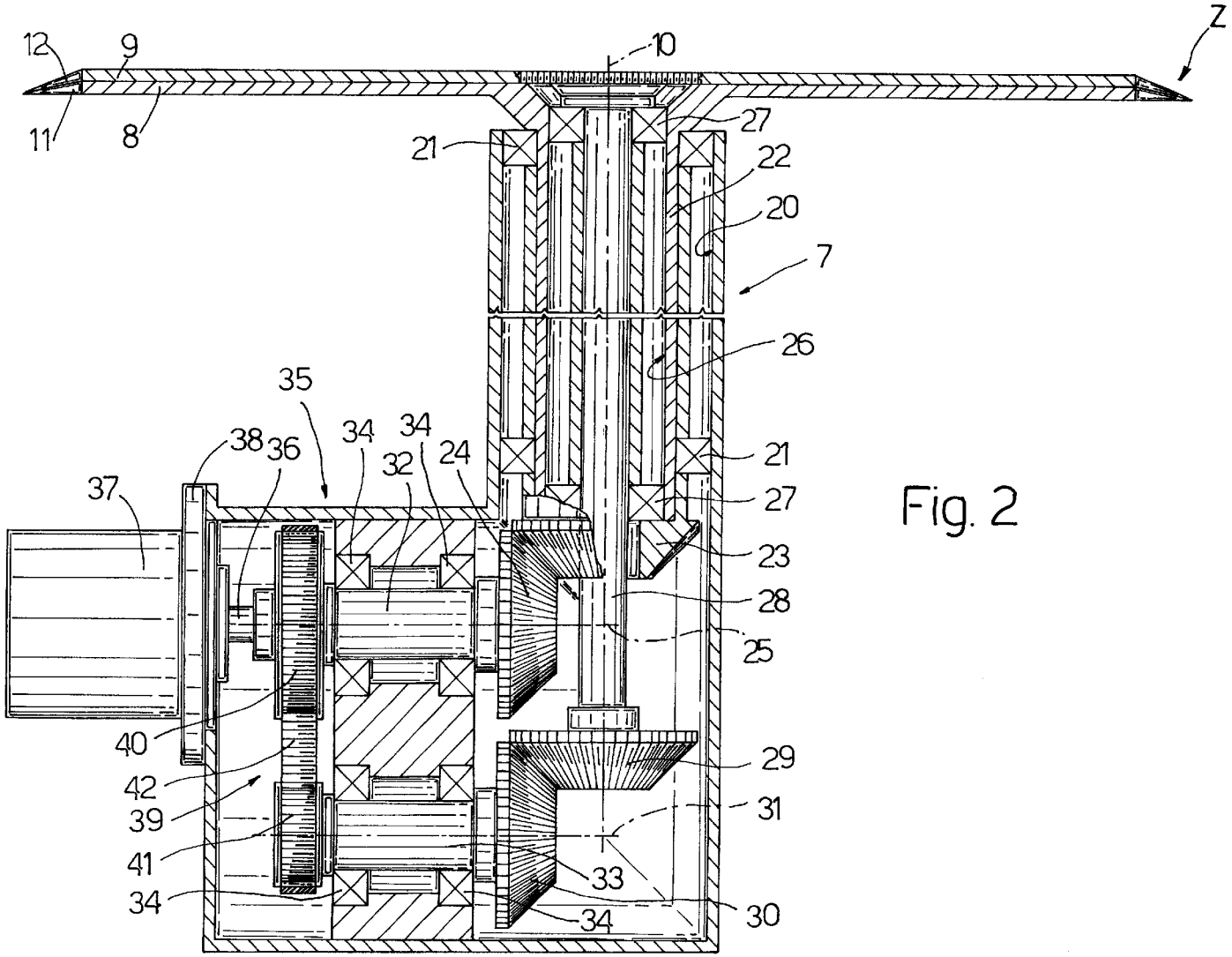
FIG. 2 shows a larger-scale section of a detail in FIG. 1.

As shown more clearly in FIG. 2, shaving device 1 comprises a tubular body 7 supporting two disks 8 and 9 (a bottom and top disk respectively), which are substantially the same shape and size and are mounted coaxially with each other to rotate independently of each other about a common axis 10 crosswise to path P.

Disks 8 and 9 are mounted one over and substantially contacting the other, so as to slide with respect to each other and rotate about axis 10 at different speeds and/or in different directions.

As shown in FIG. 1, disks 8 and 9 are positioned parallel to path P, and have respective serrated outer edges 11 and 12, which are superimposed and substantially contact each other along a portion Z corresponding to the whole extension of the edges.

Edges 11 and 12 interfere with bead 2 along path P, and comprise respective successions of teeth 13 and 14.

Figure 3:
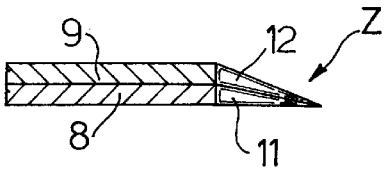
FIG. 3 shows a larger-scale view of a detail in FIG. 2.
Figure 4:
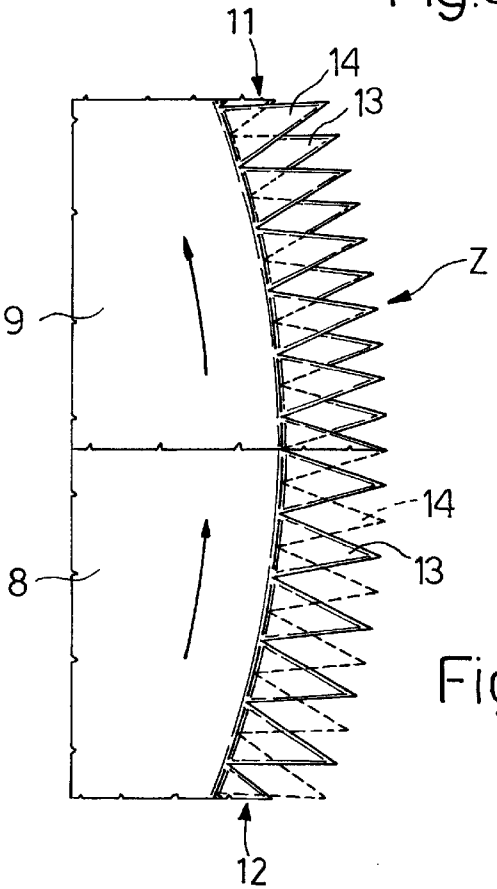
FIG. 4 shows a larger-scale plan view of a further detail in FIG. 2.

As shown more clearly in FIGS. 3 and 4, serrated edges 11 and 12 are superimposed, so that, as disks 8 and 9 rotate about axis 10 at different speeds, teeth 13 and 14 intersect one another to "scissor" cut the fibers of tobacco 3 fed onto edges 11 and 12 by supply device 4.

As shown in FIG. 1, shaving device 1 also comprises a known suction device 15 for removing the tobacco 3 shaved by disks 8 and 9; and a known compacting device 16 located along path P, immediately upstream from disks 8 and 9 in the traveling direction of bead 2 of tobacco 3, to form in bead 2 an orderly succession of higher-density portions located at successive cutting lines of bead 2 to compact tobacco 3 in known manner at the tips of the cigarettes (not shown).

Compacting device 16 comprises a substantially cylindrical body 17, which is powered to rotate, in time with the forward travel of bead 2, about an axis 18 crosswise and close to path P, and has a projection 19 for cyclically compressing a portion of tobacco 3 in bead 2.

As shown in FIG. 2, tubular body 7 has a cylindrical inner hole 20 coaxial with axis 10 and fitted inside, by means of a pair of thrust bearings 21, with a hollow shaft 22, which is angularly integral with disk 8 and terminates with a bevel gear 23 perpendicular to axis 10 and meshing with a bevel gear 24 having an axis 25 perpendicular to axis 10.

Hollow shaft 22 has a cylindrical inner hole 26 coaxial with axis 10 and fitted inside, by means of a pair of thrust bearings 27, with a shaft 28, which is angularly integral with disk 9 and terminates with a bevel gear 29 crosswise to axis 10 and meshing with a bevel gear 30 having an axis 31 perpendicular to axis 10 and parallel to axis 25.

Gears 23 and 29 are identical, and are located parallel to each other and offset axially along axis 10.

Similarly, gears 24 and 30 are also identical, and are located parallel to each other and angularly integral with respective shafts 32 and 33, which are parallel to each other and fitted in rotary manner, by means of respective pairs of bearings 34, to a tubular appendix 35 projecting transversely from body 7.

Shaft 32 of gear 24 is angularly integral with a shaft 36 of a known motor 37 fitted to appendix 35 by means of a flange 38; and shafts 36 and 33 are made angularly integral by a belt connecting device 39 comprising a toothed pulley 40 fitted to shaft 36, a toothed pulley 41 fitted to shaft 33, and a toothed belt 42 extending about pulleys 40 and 41.

Pulleys 40 and 41 have different diameters so as to rotate shaft 33 in the same direction as but at a different angular speed from that of shaft 32.

These different angular speeds are transmitted by the two bevel gear connections 23–24 and 29–30 to shafts 22 and 28, and therefore to disks 8 and 9, which are rotated about axis 10 in the same direction but at different angular speeds.

Figure 5:
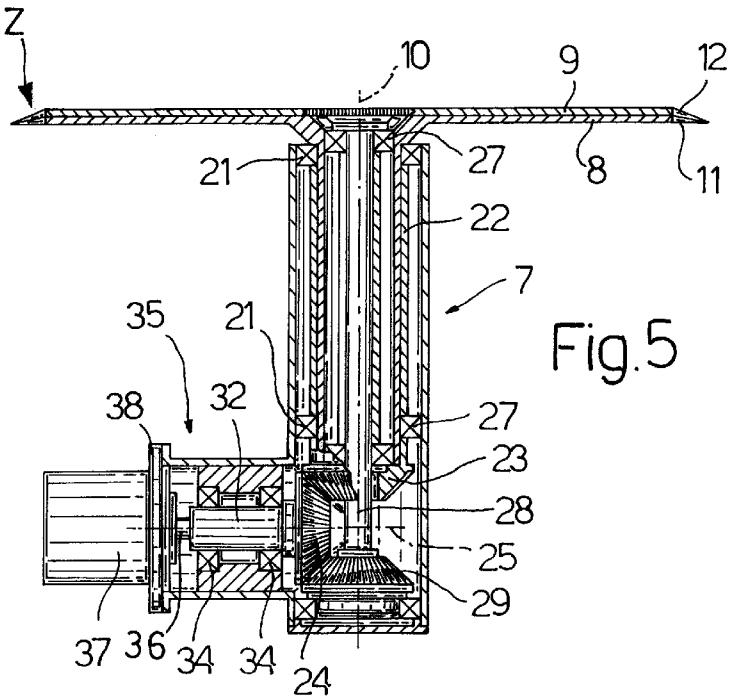
FIG. 5 shows a section of the FIG. 2 detail according to a different embodiment.

In the FIG. 5 embodiment, shaft 36 of motor 37 is connected by shaft 32 solely to gear 24, which meshes simultaneously with gears 23 and 29, which are coaxial and oppositely conical, so that, when shaft 36 is rotated by motor 37, shafts 22 and 28, and therefore disks 8 and 9, rotate in opposite directions at the same angular speed.

In a different embodiment not shown, motor 37 rotates disks 8 and 9 about axis 10 in opposite directions and at different angular speeds.

In a further embodiment not shown, one disk 8, 9 is fixed and only the other disk 9, 8 rotates about axis 10.

Operation of shaving device 1 is clearly deducible from the foregoing description with no further explanation required.

Figure 6:
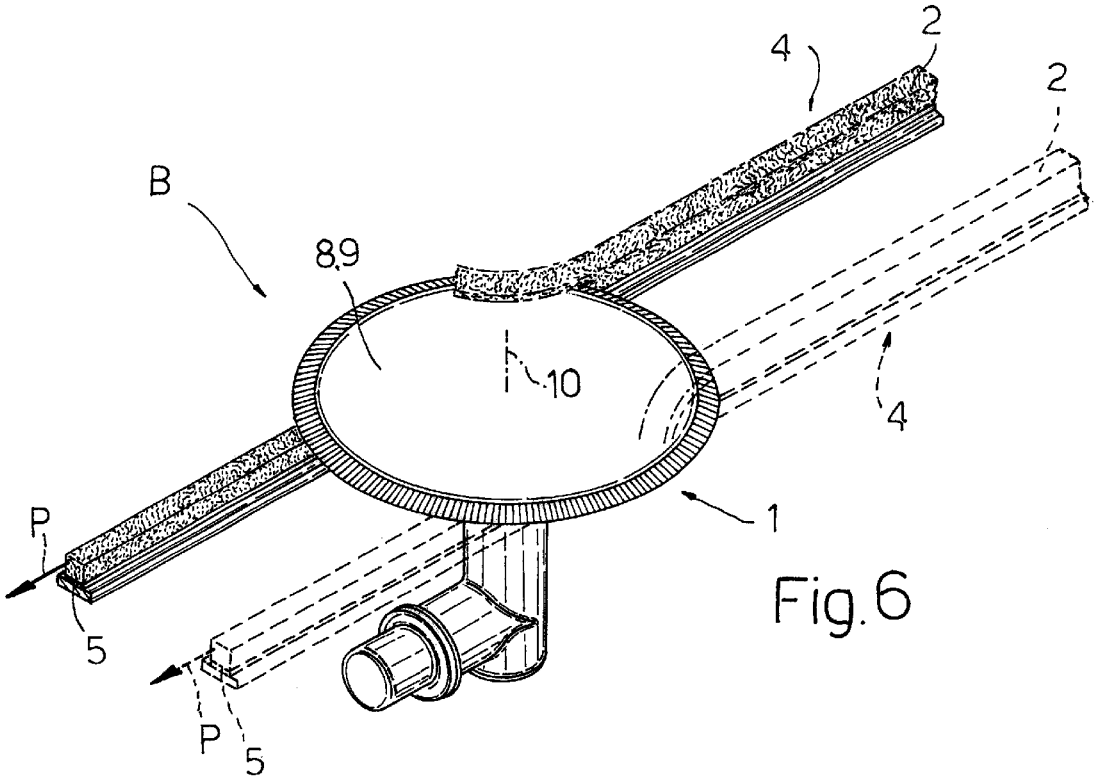
FIGS. 6 and 7 show views in perspective of two different embodiments of the FIG. 1 machine.
Figure 7:
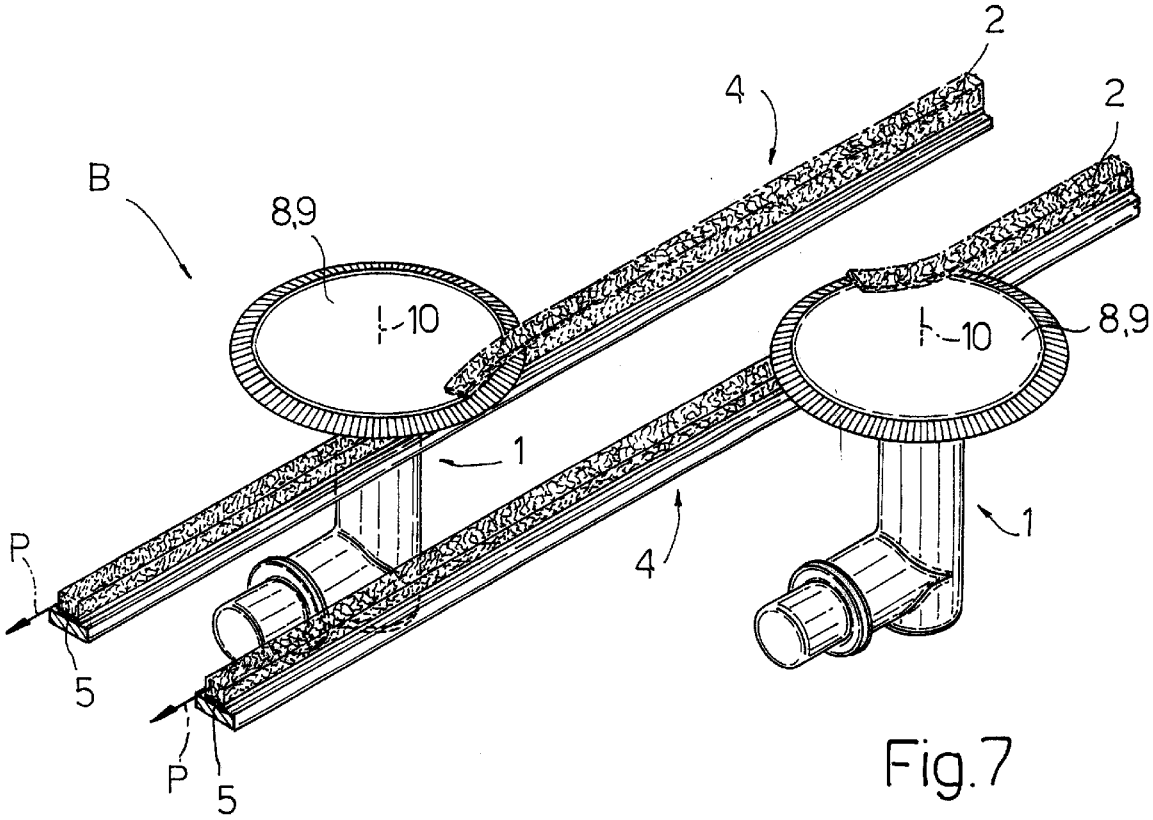

FIGS. 6 and 7 show a dual manufacturing machine B for simultaneously producing two beads 2 of tobacco 3.

In this case, supply device 4 comprises two belts 5 for feeding two beads 2 of tobacco 3 along respective parallel paths P.

In a first embodiment shown in FIG. 6, a single shaving device 1 is located with axis 10 extending between and crosswise to beams 6 to simultaneously shave both beads 2.

In an alternative embodiment shown in FIG. 7, machine B comprises two shaving devices 1, each associated with a respective belt 5 for shaving a respective bead 2.

Devices 1 are located with respective axes 10 aligned with each other in a direction perpendicular to paths P of tobacco beads 2.

Though more expensive, this solution is normally preferred by enabling the shaving height of each bead 2 to be varied independently.

Figure 8:
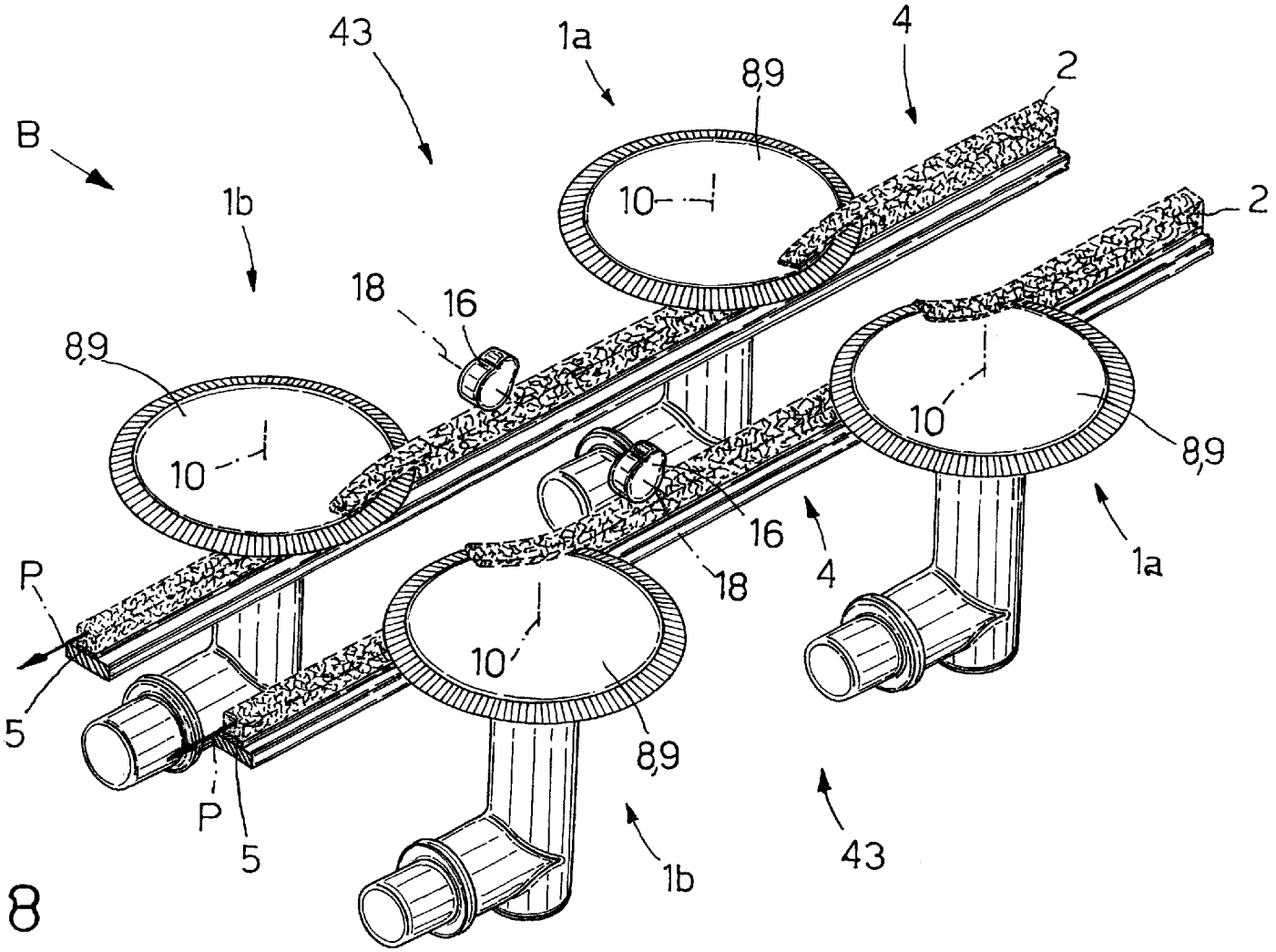
FIG. 8 shows a view in perspective of a further application of the FIG. 1 machine.

In a further embodiment shown in FIG. 8, machine B comprises two pairs 43 of shaving devices 1. Each pair 43 is associated with a respective belt 5 to shave a respective bead 2, and the two shaving devices 1 (indicated 1*a* and 1*b* in FIG. 8) are arranged in series along path P of respective bead 2.

Device 16 for compacting respective tobacco bead 2 is located between the two shaving devices 1 in the same pair 43.

In actual use, and for each pair 43, shaving device 1*a*, located upstream in the traveling direction of bead 2, performs a first shaving operation to level off tobacco 3 in bead 2, which is then compacted as described above by respective compacting device 16, and shaved by shaving device 1*b* downstream in the traveling direction of bead 2.

Shaving devices 1*a* in the two pairs 43 are located with respective axes 10 aligned in a direction perpendicular to paths P of tobacco beads 2; and, likewise, shaving devices 1*b* in the two pairs 43 are also located with respective axes 10 aligned in a direction perpendicular to paths P of tobacco beads 2.

In the FIG. 8 embodiment, the first shaving operation of each bead 2 provides for highly uniform compaction of bead 2, thus reducing the tip-filling defects of the cigarettes (not shown) produced on machine B.

By virtue of the compact design of shaving devices 1, the above embodiment may be used on existing manufacturing machines with no particular alterations required (in particular, no increase in the size of the shaving region).

In a further embodiment not shown, the two shaving devices 1*a* for preshaving beads 2 may be replaced by a single shaving device 1, as shown in FIG. 6, for shaving both beads 2.

Figure 9:
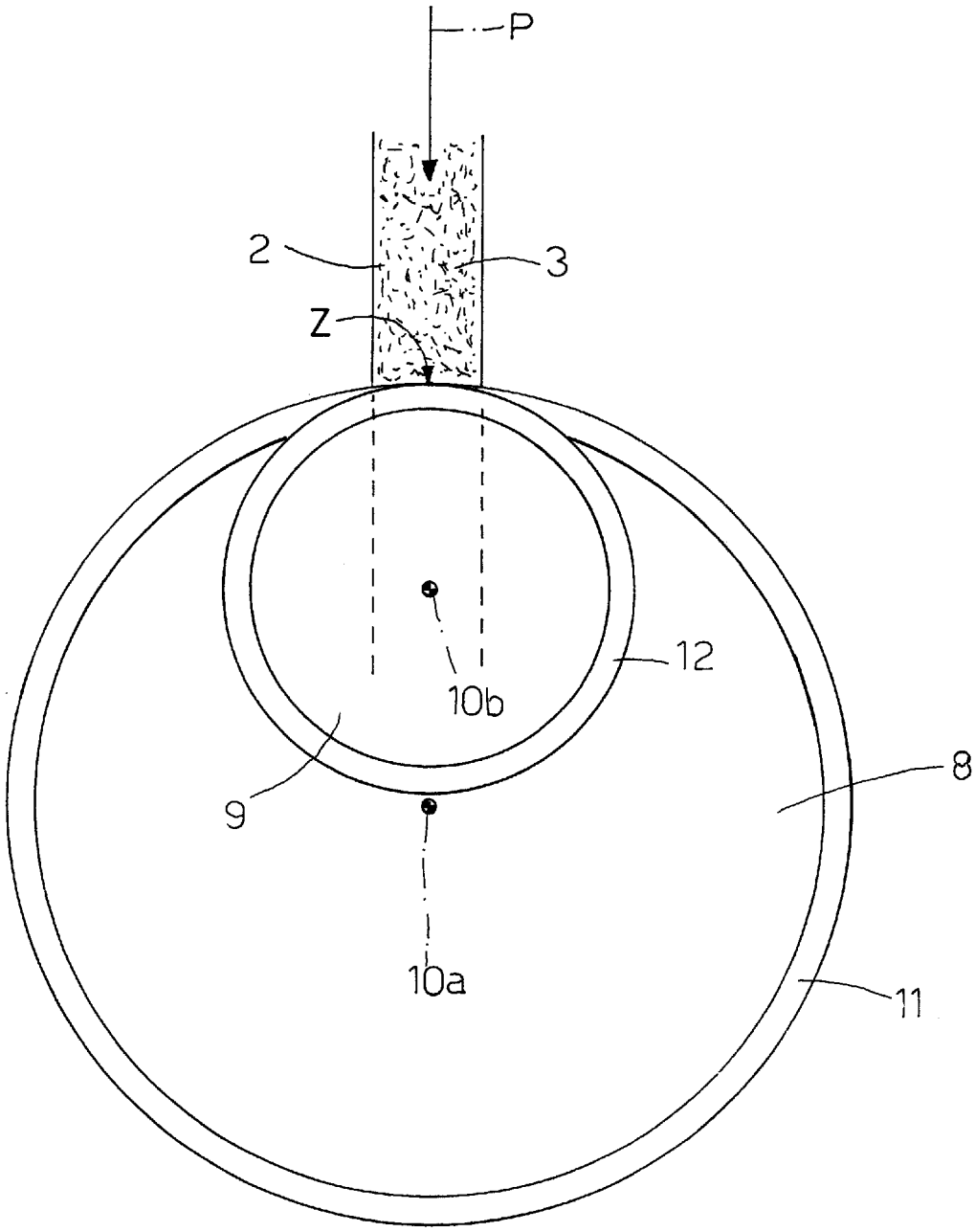
FIG. 9 shows a larger-scale plan view, with parts removed for clarity, of a further embodiment of a detail of the FIG. 1 machine.

As shown in FIG. 9, shaving device 1 comprises two disks 8 and 9 (a bottom and top disk respectively) of different sizes and mounted to rotate independently about respective axes 10*a* and 10*b*, which are parallel to each other and perpendicular to path P of bead 2 of tobacco 3.

Disks 8 and 9 are mounted one over and substantially contacting the other, so as to slide with respect to each other and rotate about respective axes 10*a* and 10*b* at different speeds and/or in different directions.

As shown in FIG. 9, disks 8 and 9 are positioned parallel to path P, and have respective serrated outer edges 11 and 12, which are substantially tangent to each other at a superimposed portion Z along path P to interfere with bead 2, and comprise respective successions of teeth (not shown in FIG. 9).

Serrated edges 11 and 12 are so superimposed that, as disks 8 and 9 rotate at different speeds about respective axes 10*a* and 10*b*, the teeth of edges 11 and 12 intersect at superimposed portion Z to "scissor" cut the fibers of tobacco 3 fed onto portion Z.

What is claimed is:

1. A cigarette manufacturing machine comprising supply means for feeding at least one bead of tobacco along a given path; and at least one shaving device located along said path to shave said bead, and which in turn comprises two shaving disks, each parallel to said path and mounted to rotate about a respective axis crosswise to said path; wherein said two shaving disks comprise respective serrated outer edges having a superimposed portion interfering with said bead along said path, and comprising respective succession of teeth; said shaving device also comprising actuating means for imparting to said two shaving disks a relative speed with respect to each other to "scissor" cut the bead.

2. A machine as claimed in claim 1, wherein said two shaving disks are mounted coaxial with each other to rotate about a single axis crosswise to said path.

3. A machine as claimed in claim 1, wherein said supply means comprise two parallel conveyors, each for feeding a respective said bead along a respective said path; the machine comprising two shaving devices, each connected to a respective said conveyor to shave a respective said bead.

4. A machine as claimed in claim 3, wherein the respective axes of said two shaving devices are aligned with each other in a direction perpendicular to said paths.

5. A machine as claimed in claim 1, wherein said supply means comprise two parallel conveyors, each for feeding a respective said bead along a respective said path; said shaving device being located between said two conveyors to shave both said beads.

6. A machine as claimed in claim 1 further comprising at least one pair of shaving devices, which are arranged in series along said path to shave said bead of tobacco.

7. A machine as claimed in claim 1 further comprising a compacting device located along said path, immediately upstream from said two shaving disks in a traveling direction of the bead of tobacco.

8. A machine as claimed in claim 1 further comprising a suction device for removing the shaved tobacco.

9. A cigarette manufacturing machine comprising supply means for feeding at least one bead of tobacco along a given path; and at least one shaving device located along said path to shave said bead, and which in turn comprises two shaving disks, each parallel to said path and mounted to rotate about a respective axis crosswise to said path; wherein said two shaving disks comprise respective serrated outer edges having a superimposed portion interfering with said bead along said path; said shaving device also comprising actuating means for imparting to said two shaving disks a relative speed with respect to each other; said two shaving disks being mounted coaxial with each other to rotate about a single axis crosswise to said path.

10. A machine as claimed in claim 9, wherein at least a first of said two shaving disks is mounted for rotation about said axis; said actuating means being connected to at least said first shaving disk to rotate the first shaving disk about said axis.

11. A machine as claimed in claim 9, wherein each of said two shaving disks is mounted for rotation about said axis; said actuating means being connected to both said two shaving disks to rotate each said shaving disk about said axis.

12. A machine as claimed in claim 11, wherein said actuating means are connected to said two shaving disks to rotate said two shaving disks about said axis in the same rotation direction and at different angular speeds.

13. A cigarette manufacturing machine comprising supply means for feeding at least one bead of tobacco along a given path; and at least one shaving device located along said path to shave said bead, and which in turn comprises two shaving disks, each parallel to said path and mounted to rotate about a respective axis crosswise to said path; wherein said two shaving disks comprise respective serrated outer edges having a superimposed portion interfering with said bead along said path; said shaving device also comprising actuating means for imparting to said two shaving disks a relative speed with respect to each other; said supply means comprise two parallel conveyors, each for feeding a respective said bead along a respective said path; said shaving device being located between said two conveyors to shave both said beads.

14. A cigarette manufacturing machine comprising supply means for feeding at least one bead of tobacco along a given path; and at least one shaving device located along said path to shave said bead, and which in turn comprises two shaving disks, each parallel to said path and mounted to rotate about a respective axis crosswise to said path; wherein said two shaving disks comprise respective serrated outer edges having a superimposed portion interfering with said bead along said path, and comprising respective succession of teeth; said shaving device also comprising actuating means for imparting to said two shaving disks a relative speed with respect to each other to "scissor" cut the bead; said shaving disks being mounted one over and substantially contacting the other; the edge of one disk being contained within the edge of the other disk.

* * * * *

UNITED STATES PATENT AND TRADEMARK OFFICE

CERTIFICATE OF CORRECTION

PATENT NO. : 6,250,310 B1
DATED : June 26, 2001
INVENTOR(S) : Mario Spatafora

It is certified that error appears in the above-identified patent and that said Letters Patent is hereby corrected as shown below:

Title page,
Item [73] should read as follows: -- (73) Assignee: G.D Societa´ Per Azioni, Bologna (IT) --.

Signed and Sealed this

Eleventh Day of June, 2002

*Attest:*

*Attesting Officer*

JAMES E. ROGAN
*Director of the United States Patent and Trademark Office*